US008353283B2

(12) United States Patent
Oglesby et al.

(10) Patent No.: US 8,353,283 B2
(45) Date of Patent: Jan. 15, 2013

(54) GAS CATALYTIC COMBUSTION ELEMENT AND A GAS POWERED HEATING DEVICE

(75) Inventors: Alfred Peter Oglesby, Carlingford (IE); John Paul Oglesby, Carlow (IE)

(73) Assignee: Oglesby & Butler Research & Development Limited, Carlow (IE)

( * ) Notice: Subject to any disclaimer, the term of this patent is extended or adjusted under 35 U.S.C. 154(b) by 1158 days.

(21) Appl. No.: 11/575,752

(22) PCT Filed: Sep. 22, 2005

(86) PCT No.: PCT/IE2005/000103

§ 371 (c)(1), (2), (4) Date: May 7, 2007

(87) PCT Pub. No.: WO2006/033091

PCT Pub. Date: Mar. 30, 2006

(65) Prior Publication Data

US 2008/0041360 A1 Feb. 21, 2008

(30) Foreign Application Priority Data

Sep. 22, 2004 (IE) ..... S2004/0641

(51) Int. Cl.
*B23K 3/02* (2006.01)

(52) U.S. Cl. ..... 126/414; 431/268

(58) Field of Classification Search ..... 126/401–414; 431/268, 347, 7, 328, 326, 329; 401/1–2; 222/113, 146.2

See application file for complete search history.

(56) References Cited

U.S. PATENT DOCUMENTS 3,031,870 A * 5/1962 Markus-Markush ..... 431/127
3,085,402 A * 4/1963 Anderson ..... 60/39.822
4,726,767 A * 2/1988 Nakajima ..... 432/222
4,755,073 A * 7/1988 Girardin et al. ..... 401/1
5,094,611 A * 3/1992 Suppiah et al. ..... 431/268

(Continued)

FOREIGN PATENT DOCUMENTS

EP 0 846 911 6/1998

(Continued)

OTHER PUBLICATIONS

Patent Abstracts of Japan, vol. 010, No. 242 (M-509) dated Aug. 21, 1986, corresponding to JP 61 072912 A (Matsushita Electric Ind Co., Ltd.) dated Apr. 15, 1986.

*Primary Examiner* — Thomas Denion
*Assistant Examiner* — Daniel Bernstein
(74) *Attorney, Agent, or Firm* — Sughrue Mion, PLLC

(57) ABSTRACT

A glue gun (10) comprising a body member (3) in which a glue accommodating and melting chamber (4) for receiving stick glue is formed and combustion chamber 910) is also formed for accommodating a gas catalytic combustion element (14). A temperature responsive valve (25) controls the supply of fuel gas to the combustion chamber 910) for maintaining the temperature of the body member (3) at approximately 140° C. A thermal mass (2) provided by a screw (27) is clamped onto a tab shaped portion (30) of the bas catalytic combustion element (14), and maintains the temperature of the tab shaped portion (30) above the ignition temperature of the gas catalytic combustion element (14) during periods of fuel gas interruption to the combustion chamber (10), so that when the temperature responsive valve (25) restores the supply of fuel gas, the tab shaped portion (30) immediately commences to convert fuel gas to heat by catalytic reaction, thus rapidly raising the temperature of the gas catalytic combustion element (14) to its ignition temperature.

26 Claims, 3 Drawing Sheets

U.S. PATENT DOCUMENTS

Figure 1:
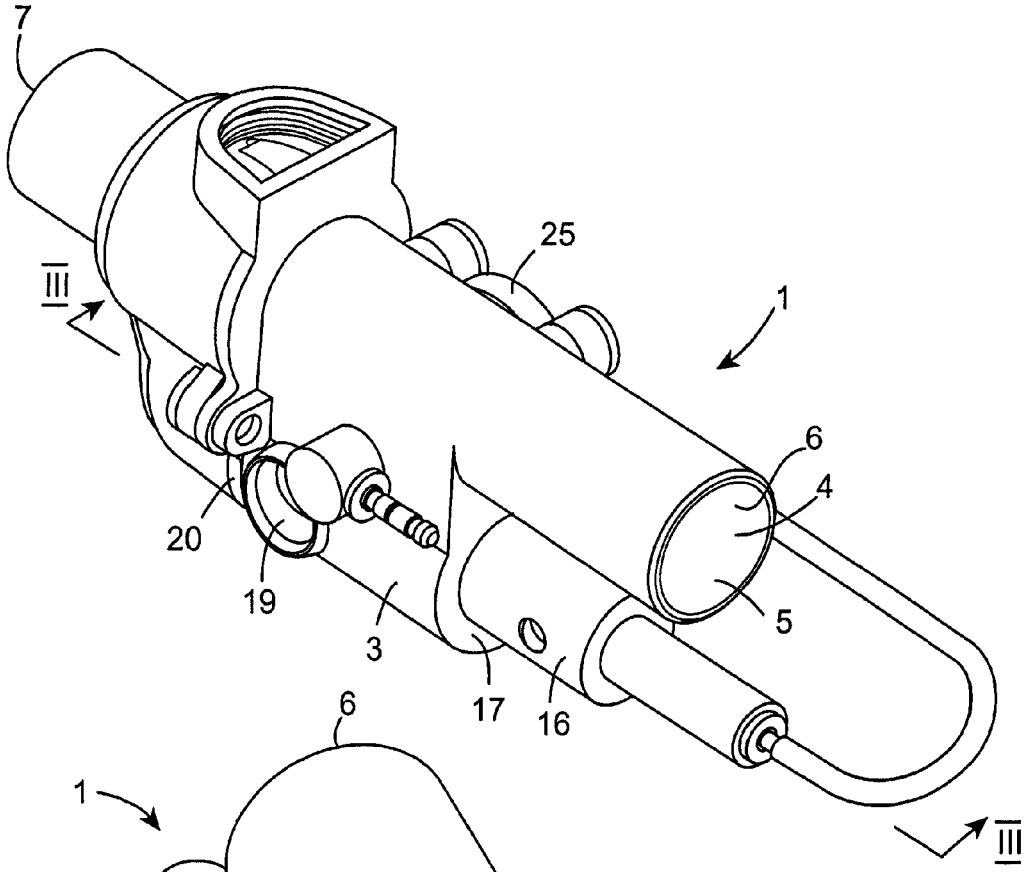

| | | | | | |
|---|---|---|---|---|---|
| 5,771,881 | A | * | 6/1998 | Oglesby et al. | 126/414 |
| 5,799,648 | A | * | 9/1998 | Oglesby et al. | 126/414 |
| 5,960,996 | A | * | 10/1999 | Hsu | 222/113 |
| 6,244,853 | B1 | * | 6/2001 | Oglesby et al. | 431/6 |
| 6,497,571 | B1 | * | 12/2002 | McAlonan et al. | 431/328 |

FOREIGN PATENT DOCUMENTS

| | | | | |
|---|---|---|---|---|
| EP | 1 036 982 | | | 9/2000 |
| GB | 2263243 | A | * | 7/1993 |
| JP | 59115903 | A | * | 7/1984 |

* cited by examiner

GAS CATALYTIC COMBUSTION ELEMENT AND A GAS POWERED HEATING DEVICE

The present invention relates to a gas catalytic combustion element for use in a gas powered heating device, and to a gas powered heating device. The invention also relates to a method for operating a gas catalytic combustion element for maintaining the temperature of a portion of the gas catalytic combustion element at or above the ignition temperature of the gas catalytic combustion element during periods of fuel gas interruption.

Gas powered heating devices whereby fuel gas is converted to heat by a catalytic reaction with a gas catalytic combustion element are well known. Typically, such gas powered heating devices are used as soldering irons, glue guns, hair curling tongs, hairdryers and other devices where portability of the device is a requirement, although, as will be well known to those skilled in the art, devices in which fuel gas is converted to heat by catalytic reaction need not necessarily be portable. In general, such gas powered heating devices, which are provided in the form of soldering irons or glue guns comprise a body member of a heat conductive material within which a combustion chamber is formed, and a gas catalytic combustion element is located in the combustion chamber. A fuel gas/air mixture is delivered into the combustion chamber where it reacts with the gas catalytic combustion element and is converted by a catalytic reaction in the gas catalytic combustion element to heat. The body member is heated by radiation, convection and conduction of heat from the gas catalytic combustion element, and acts as a thermal mass which can be maintained within a relatively narrow temperature band width despite relatively wide fluctuations in the temperature of the gas catalytic combustion element, which result from periodic interruptions of the supply of fuel gas/air mixture to the catalytic combustion element, which are required in order to maintain the temperature of the body member substantially constant.

Where it is desired to control the temperature of the body member within relatively narrow temperature band width, a temperature responsive valve is commonly located on the body member or in heat conducting engagement therewith, and the fuel gas or fuel gas/air mixture is passed through the temperature responsive valve for controlling the flow thereof to the combustion chamber. If the body member is to operate within a temperature band width which is close to or below the ignition temperature of the gas catalytic combustion element, it is not uncommon for the supply of fuel gas to the combustion chamber to be periodically interrupted in order to maintain the temperature of the body member within the desired temperature band width. Since the thermal mass of the gas catalytic combustion element is relatively low, during periods of fuel gas interruption the temperature of the gas catalytic combustion element drops relatively rapidly, and if the temperature band width within which the body member is being maintained is close to the ignition temperature of the gas catalytic combustion element, the temperature of the gas catalytic combustion element may drop below its ignition temperature during periods of fuel gas interruption.

Additionally, if the temperature band width, within which the body member is being maintained is below or significantly below the ignition temperature of the catalytic combustion element, since the gas catalytic combustion element is, in general, in contact with the body member, the temperature of the gas catalytic combustion element drops rapidly below its ignition temperature on interruption of fuel gas to the gas catalytic combustion element. Accordingly, when the temperature responsive valve restores the fuel gas to the combustion chamber, the gas catalytic combustion element being below its ignition temperature fails to re-ignite, and thus fails to convert the fuel gas/air mixture to heat. In such cases the fuel gas/air mixture merely passes through the combustion chamber and is exhausted therefrom without being converted to heat. Accordingly, the fuel gas/air mixture must be manually ignited to burn in a flame by, for example, a spark igniter, a piezo-electric igniter or other such manual igniter in order to raise the temperature of the gas catalytic combustion element to its ignition temperature. This is unsatisfactory.

Gas powered heating devices which are provided in the form of gas powered hair curling tongs and hairdryers and the like, which are also powered by conversion of fuel gas to heat by a gas powered catalytic combustion element typically comprise an elongated barrel within which the gas catalytic combustion element is located. In such cases, the gas catalytic combustion element, in general, is not in direct heat conducting engagement with the barrel. In hair curling tongs the gas catalytic combustion element is located within the barrel spaced apart from the barrel wall, and heat is radiated from the gas catalytic combustion element to the barrel wall. In the case of a hair dryer, the gas catalytic combustion element is located in an air duct within the barrel and is spaced apart from the wall of the duct. Heat is transferred to an air stream being blown through the duct by radiation and convection. A temperature responsive valve is responsive to the temperature of the barrel in the case of a hair curling tongs, and to the air stream in the case of a hairdryer, and controls the supply of fuel gas to the gas catalytic combustion element, for in turn controlling the temperature of the barrel or the air stream being delivered from the barrel, as the case may be.

In general, the supply of fuel gas to the gas catalytic combustion element is periodically interrupted by the temperature responsive valve in order to maintain the temperature of the barrel or the air stream at a desired temperature. Due to the relatively low thermal mass of gas catalytic combustion elements, on the supply of fuel gas being interrupted to the gas catalytic combustion element, the temperature of the gas catalytic combustion element commences to drop relatively rapidly. Accordingly, unless the supply of fuel gas is restored to the gas catalytic combustion element within a relatively short time period, the temperature of the gas catalytic combustion element falls below its ignition temperature, and thus fails to ignite when the supply of fuel gas is restored, and the fuel gas/air mixture passes through the catalytic combustion element unignited and without being converted to heat. This is also undesirable.

Accordingly, there is a need for a gas powered heating device which permits the control of the temperature of the device or an aspect of the device which addresses the problems of such known gas powered heating devices. There is also a need for a gas catalytic combustion element which similarly addresses these problems, and there is a need for a method for operating a gas catalytic combustion element for maintaining the temperature of a portion of the gas catalytic combustion element at or above the ignition temperature of the gas catalytic combustion element during periods of interruption of fuel gas to the gas catalytic combustion element.

The present invention is directed towards providing a gas powered heating device, a gas catalytic combustion element and a method for operating a gas catalytic combustion element for maintaining the temperature of the gas catalytic combustion element at or above the ignition temperature of the gas catalytic combustion element during periods of interruption of fuel gas which addresses the problems of prior art devices and methods.

According to the invention there is provided a gas catalytic combustion element for converting fuel gas to heat, the gas catalytic combustion element having a thermal mass associated therewith, the thermal mass being of size to store sufficient heat for maintaining a portion of the gas catalytic combustion element adjacent the thermal mass at or above the ignition temperature thereof during periods of fuel gas interruption to the gas catalytic combustion element, so that when the fuel gas supply is restored to the gas catalytic combustion element, the portion of the gas catalytic combustion element adjacent the thermal mass commences to convert the fuel gas to heat by catalytic action for raising the temperature of the remainder of the gas catalytic combustion element to its ignition temperature.

In one embodiment of the invention the thermal mass is in heat transfer relationship with the gas catalytic combustion element, so that heat is transferred from the gas catalytic combustion element to the thermal mass during periods when the gas catalytic combustion element is converting fuel gas to heat, and heat is transferred from the thermal mass to the gas catalytic combustion element during the periods of fuel gas interruption.

Preferably, the thermal mass is located within the gas catalytic combustion element.

In another embodiment of the invention the thermal mass is in heat conducting engagement with the gas catalytic combustion element.

In one embodiment of the invention the gas catalytic combustion element is an elongated gas catalytic combustion element, and the thermal mass is located intermediate the ends thereof.

In another embodiment of the invention a bore is formed in the gas catalytic combustion element.

Advantageously, the thermal mass is located relative to the gas catalytic combustion element for facilitating the passage of fuel gas between the thermal mass and the gas catalytic combustion element.

In one embodiment of the invention the thermal mass is clamped onto the gas catalytic combustion element adjacent the portion, the temperature of which is to be maintained at or above the ignition temperature.

In another embodiment of the invention the portion of the gas catalytic combustion element onto which the thermal mass is clamped is formed by a tab shaped portion of the gas catalytic combustion element. Preferably, the tab shaped portion of the gas catalytic combustion element extends into the bore formed therein, and advantageously, the tab shaped portion of the gas catalytic combustion element extends transversely into the bore formed therein.

In one embodiment of the invention the thermal mass comprises a screw having a head and a threaded shank extending therefrom, and a nut is provided on the shank for clamping the portion of the gas catalytic combustion element between the head and the nut.

Preferably, the thermal mass is located within the bore of the gas catalytic combustion element.

Alternatively, the thermal mass comprises a plug member.

In one embodiment of the invention the plug member is of transverse cross-section such as to engage the gas catalytic combustion element at spaced apart locations around the periphery of the plug member.

In another embodiment of the invention the plug member is in heat conducting engagement with the gas catalytic combustion element at the spaced apart location, and co-operates with the gas catalytic combustion element for accommodating the passage of fuel gas between the plug member and the gas catalytic combustion element at locations between the spaced apart locations at which the plug member engages the gas catalytic combustion element.

Advantageously, the transverse cross-section of the plug member is different to the transverse cross-section of the bore formed in the gas catalytic combustion element within which the thermal mass is located.

In one embodiment of the invention the plug member is of circular transverse cross-section.

In an alternative embodiment of the invention the plug member is of polygonal cross-section.

In one embodiment of the invention the gas catalytic combustion element is of polygonal transverse cross-section.

In another embodiment of the invention the gas catalytic combustion element is of square transverse cross-section.

In a further embodiment of the invention the gas catalytic combustion element is of rectangular transverse cross-section.

In a still further embodiment of the invention the gas catalytic combustion element is of circular transverse cross-section.

Preferably, the thermal mass is of heat conducting material. Advantageously, the thermal mass is of metal, and in one embodiment of the invention the thermal mass is of steel.

In another embodiment of the invention the gas catalytic combustion element is of tubular construction having an elongated bore extending axially therethrough.

In one embodiment of the invention the gas catalytic combustion element comprises a substrate and a catalytic material coated onto the substrate.

In one embodiment of the invention the substrate comprises metal mesh material.

In another embodiment of the invention the substrate comprises a fibrous material.

In a further embodiment of the invention the substrate comprises ceramics material.

In one embodiment of the invention the catalytic material comprises a precious metal.

In an alternative embodiment of the invention the thermal mass is formed by a portion of the substrate.

The invention also provides a gas powered heating device comprising a gas catalytic combustion element according to the invention.

The invention further provides a gas powered heating device comprising a gas catalytic combustion element for converting fuel gas to heat, and a thermal mass associated with the gas catalytic combustion element, the thermal mass being of size to store sufficient heat for maintaining a portion of the gas catalytic combustion element adjacent the thermal mass at or above the ignition temperature of the gas catalytic combustion element during periods of fuel gas interruption thereto, so that when the fuel gas supply is restored to the gas catalytic combustion element, the portion of the gas catalytic combustion element adjacent the thermal mass commences to convert the fuel gas to heat by catalytic action for raising the temperature of the remainder of the gas catalytic combustion element to its ignition temperature.

In one embodiment of the invention the thermal mass is in heat transfer relationship with the gas catalytic combustion element, so that heat is transferred from the gas catalytic combustion element to the thermal mass during periods when the gas catalytic combustion element is converting fuel gas to heat, and heat is transferred from the thermal mass to the gas catalytic combustion element during the periods of fuel gas interruption.

In one embodiment of the invention the gas catalytic combustion element is located in a combustion chamber formed within a body member.

In another embodiment of the invention the thermal mass is located in the gas catalytic combustion element so that the thermal mass is not in direct heat transfer relationship with the body member.

In another embodiment of the invention the thermal mass is located in the gas catalytic combustion element so that the thermal mass is substantially heat isolated from the body member.

Preferably, the gas catalytic combustion element is located in the combustion chamber for facilitating the passage of fuel gas between the gas catalytic combustion element and the body member.

In one embodiment of the invention the combustion chamber is formed by an elongated bore extending into the body member, the transverse cross-section of the bore forming the combustion chamber being different to the transverse cross-section of the gas catalytic combustion element for minimising contact between the gas catalytic combustion element and the body member. Preferably, the bore forming the combustion chamber is of circular transverse cross-section.

In one embodiment of the invention the body member is of a heat conducting material, and the gas catalytic combustion element is located in the combustion chamber for facilitating heat transfer from the gas catalytic combustion element to the body member.

Advantageously, the gas catalytic combustion element is located in the combustion chamber for facilitating heat transfer from the gas catalytic combustion element to the body member by radiant heat transfer.

Advantageously, the combustion chamber defines a longitudinally extending central axis, and the gas catalytic combustion element defines a longitudinally extending central axis which coincides with the central axis of the combustion chamber.

In one embodiment of the invention the device is a glue gun, and an elongated tubular glue accommodating chamber is formed in the body member for accommodating a stick of hot melt glue for melting the stick glue therein.

In another embodiment of the invention the device is a soldering iron, and the body member terminates in a soldering tip.

Additionally, the invention provides a method for operating a gas catalytic combustion element for maintaining the temperature of a portion of the gas catalytic combustion element at or above the ignition temperature of the gas catalytic combustion element during periodic periods of fuel gas interruption to the gas catalytic combustion element, the method comprising providing a thermal mass associated with the gas catalytic combustion element, the thermal mass being of size to store sufficient heat for maintaining the portion of the gas catalytic combustion element adjacent the thermal mass at or above its ignition temperature during the periods of fuel gas interruption, so that when the fuel gas supply is restored to the gas catalytic combustion element, the portion of the gas catalytic combustion element adjacent the thermal mass commences to convert the fuel gas to heat for raising the temperature of the remainder of the gas catalytic combustion element to its ignition temperature.

The advantages of the invention are many. By virtue of the fact that the temperature of a portion of the gas catalytic combustion element is maintained at or above the ignition temperature of the gas catalytic combustion element during periods of fuel gas interruption to the gas catalytic combustion element, the gas catalytic combustion element can be rapidly brought up to its ignition temperature on fuel gas being restored thereto without the need for flame combustion or other means of raising the temperature of the gas catalytic combustion element to its ignition temperature. Thus, the gas catalytic combustion element according to the invention is particularly suitable for use in devices where the temperature of a portion of the device is to be controlled at relatively low temperatures and in particular within relatively narrow temperature bandwidths, and the control of the temperature requires that the fuel gas supply to the gas catalytic combustion element is periodically interrupted. The gas catalytic combustion element according to the invention is particularly suitable for use in gas powered heating devices where the temperature of the gas powered heating device is to be maintained at a temperature at or below the ignition temperature of the gas catalytic combustion element, and indeed, significantly below the ignition temperature of the gas catalytic combustion element. Accordingly, the gas catalytic combustion element and the gas powered heating device according to the invention are particularly suitable for use in or as a glue gun, where typically, the melt temperature of glue is in the order of 140° C. or less. In such cases, a body member in which a glue melting chamber is located must be retained at a temperature of approximately or slightly above the melt temperature of the glue. Such temperatures, in general, are well below the ignition temperature of a gas catalytic combustion element. Thus, by virtue of the fact that a portion of the gas catalytic combustion element is maintained at or above the ignition temperature of the gas catalytic combustion element during periods of fuel gas interruption, on restoration of the fuel gas to the gas catalytic combustion element, the gas catalytic combustion element automatically commences to convert fuel gas to heat by catalytic action without the need to manually re-ignite the fuel gas.

Figure 2:
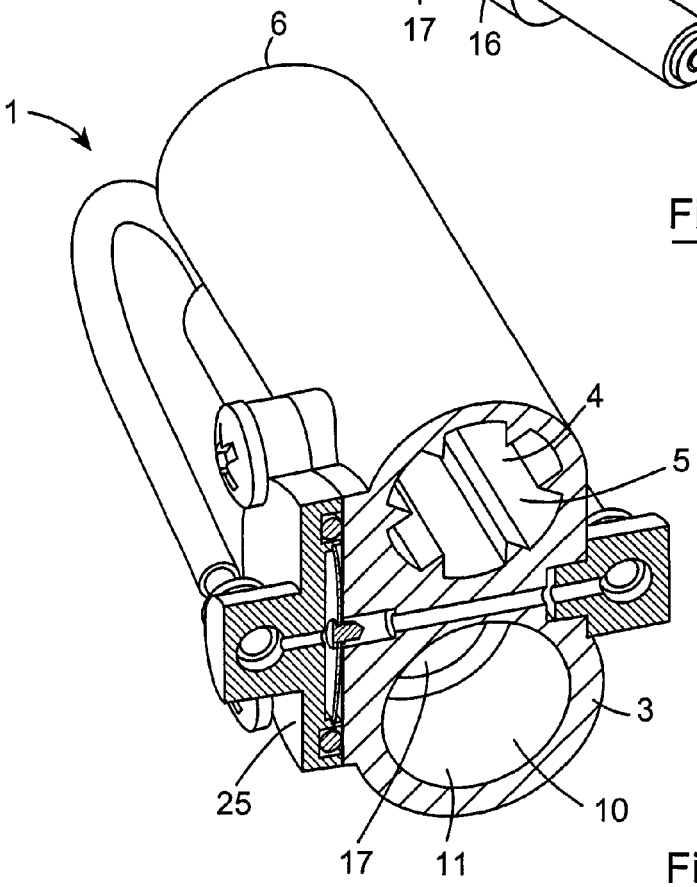
Figure 3:
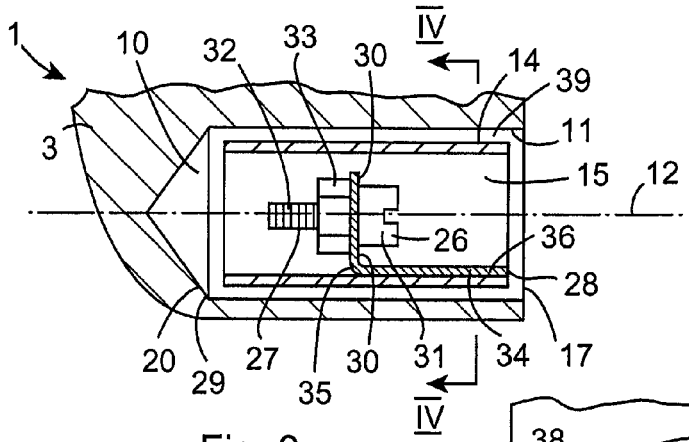
Figure 4:
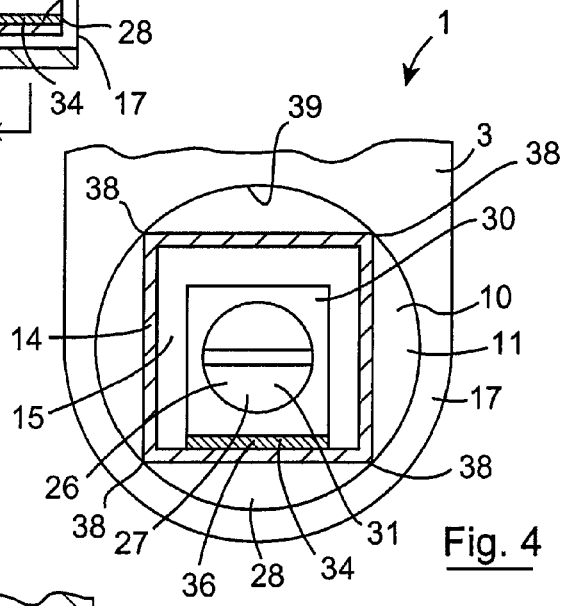
Figure 6:
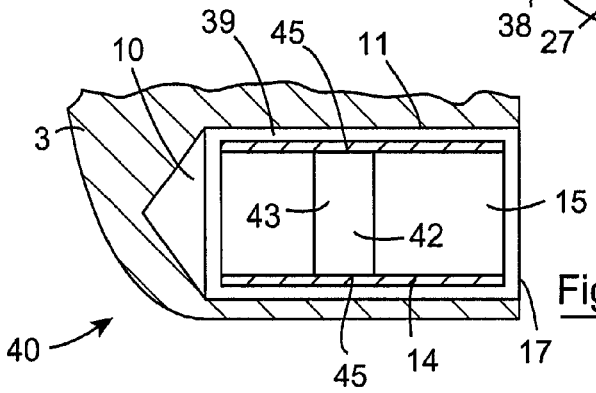
Figure 7:
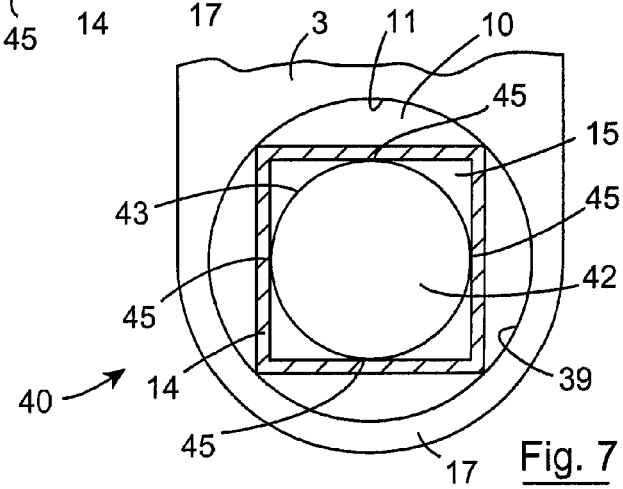
Figure 5:
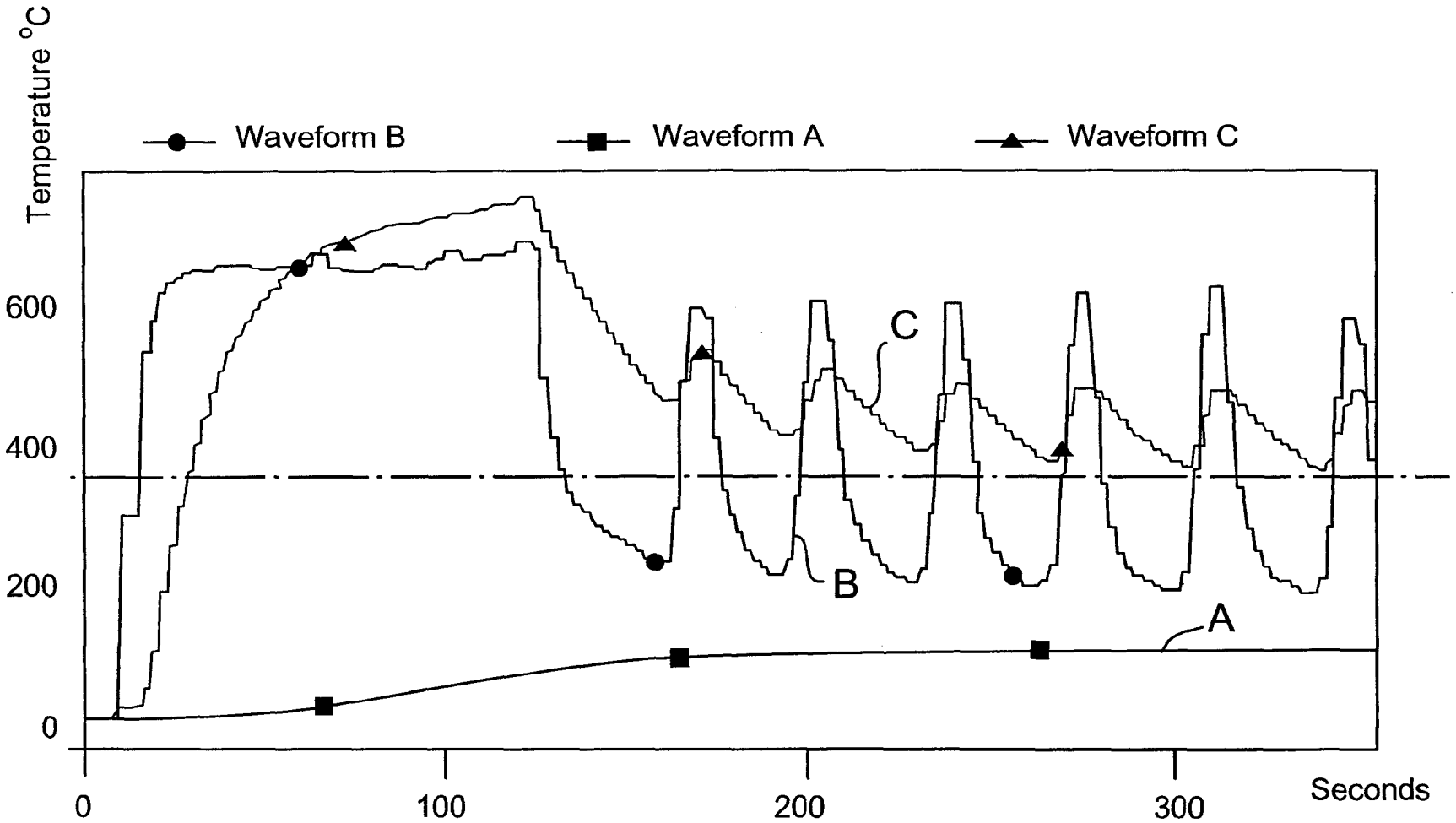

The invention will be more clearly understood from the following description of some preferred embodiments thereof, which are given by way of example only, with reference to the accompanying drawings, in which:

FIG. 1 is a perspective view of a portion of a gas powered glue gun according to the invention, FIG. 2 is a cutaway perspective view of the portion of the gas powered glue gun of FIG. 1, FIG. 3 is a transverse cross-sectional side elevational view of a portion of the glue gun of FIG. 1 on the line III-III of FIG. 1, FIG. 4 is a transverse cross-sectional end elevational view of the portion of FIG. 3 of the glue gun of FIG. 1 on the line IV-IV of FIG. 3, FIG. 5 is a graphical representation of temperatures developed by the gas powered glue gun of FIG. 1 during operation thereof, FIG. 6 is a view similar to FIG. 3 of a portion of a glue gun according to another embodiment of the invention, and FIG. 7 is a transverse cross-sectional end elevational view similar to FIG. 4 of the glue gun of FIG. 6.

Referring initially to FIGS. 1 to 4, there is illustrated a portion of a gas powered heating device according to the invention, which in this case is a portable hand-held glue gun indicated generally by the reference numeral 1. The glue gun 1 is substantially similar to a glue gun described in PCT Published Application Specification No. WO 02/48591, and the disclosure therein is incorporated herein by reference. However, only those parts of the glue gun 1, which are relevant to the invention will be described in detail. Briefly, the glue gun 1 comprises a body member 3 of heat conductive material, in this embodiment of the invention die case zinc. An elongated glue accommodating and melting chamber 4 is formed by an elongated tapering bore 5 of circular transverse cross-section extending through the body member 3 for accommodating a stick of hot melt glue for melting therein.

The bore 5 extends from an upstream end 6, into which the glue stick is inserted, to a downstream end 7 through which melted glue is extruded. An elongated combustion chamber 10 is formed by an elongated parallel bore 11 of circular transverse cross-section extending into the body member 3 parallel to the bore 5, and the combustion chamber 10 defines a longitudinally extending main central axis 12.

An elongated tubular gas catalytic combustion element 14 also according to the invention for converting a fuel gas/air mixture to heat by catalytic reaction is located in the combustion chamber 10, see FIGS. 3 and 4. The gas catalytic combustion element 14 is of square transverse cross-section having a longitudinally extending bore 15 also of square transverse cross-section extending axially therethrough, and defines a central axis which coincides with the main central axis 12 defined by the combustion chamber 10. Fuel gas is supplied from a reservoir (not shown) which is attached to the glue gun 1, to a venturi mixer 16 located at an upstream end 17 of the combustion chamber 10 where the fuel gas is mixed with air. The fuel gas/air mixture is delivered from the venturi mixer 16 through a nozzle (not shown) into the combustion chamber 10 at the upstream end 17 thereof, and in turn passes along inner and outer surfaces of the gas catalytic combustion element 14, where it is converted to heat by the catalytic reaction. An exhaust port 19 at a downstream end 20 of the combustion chamber 10 exhausts burnt fuel gas from the combustion chamber 10.

Fuel gas is supplied to the venturi mixer 16 through a temperature responsive valve 25, which is in heat conducting engagement with the body member 3, and the temperature responsive valve 25 controls the supply of fuel gas to the venturi mixer 16, and in turn to the combustion chamber 10 in order to control the temperature of the body member 3. The temperature responsive valve 25 is similar to a temperature responsive valve which is described in PCT Published Specification No. WO 02/48591, and the disclosure therein is incorporated herein by reference. In this embodiment of the invention the temperature responsive valve 25 is set to control the flow of fuel gas to the venturi mixer 16, for in turn maintaining the temperature of the body member 3 at a temperature of 140° C. within a bandwidth of approximately +5° C. and −20° C., which is significantly lower than the ignition temperature of gas catalytic combustion elements generally, which typically is of the order of 200° C. to 400° C. In this embodiment of the invention the ignition temperature of the gas catalytic combustion element 14 is approximately 275° C. In order to maintain the body member 3 at the desired temperature of 140° C., the supply of fuel gas to the venturi mixer 16, and in turn to the combustion chamber 10, is periodically temporarily interrupted by the temperature responsive valve 25.

A thermal mass 26, which in this embodiment of the invention is provided by a screw 27 is located in the bore 15 of the gas catalytic combustion element 14 intermediate ends 28 and 29 thereof. The thermal mass 26 is in heat conducting engagement with a portion, namely, a tab shaped portion 30 of the gas catalytic combustion element 14, so that heat is transferred to the thermal mass 26 from the gas catalytic combustion element 14 when the gas catalytic combustion element 14 is converting the fuel gas/air mixture to heat, and heat is transferred from the thermal mass 26 to the gas catalytic combustion element 14 during periods of fuel gas interruption to the combustion chamber 10. The screw 27 which forms the thermal mass 26 comprises a head 31, a threaded shank 32 extending from the head 31, and a nut 33 engaged on the threaded shank 32. The tab shaped portion 30 is clamped between the head 31 and the nut 33, so that the screw 27 is in heat conducting engagement with the tab shaped portion 30.

In this embodiment of the invention the tab shaped portion 30 is formed from a length of gas catalytic combustion material 34 which is similar to that of the gas catalytic combustion element 14, and has a similar ignition temperature to that of the gas catalytic combustion element 14. The length of the gas catalytic combustion material 34 is cranked at 35 to form the tab shaped portion 30 which extends transversely into the bore 15 of the gas catalytic combustion element 14, and a leg 36 which extends along and is in heat conducting engagement with the gas catalytic combustion element 14. The thermal mass 26 which includes the head 31 and the shank 32 of the screw 27 as well as the nut 33 is sized so that its thermal capacity is such as to store sufficient heat during periods while the gas catalytic combustion element 14 is converting fuel gas to heat, so that during periods of fuel gas interruption when heat is being transferred from the thermal mass 26 to the gas catalytic combustion element 14, the temperature of the tab shaped portion 30 is maintained at a temperature at or above the ignition temperature of approximately 275° C. of the gas catalytic combustion element 14, so that when the fuel gas is restored by the temperature responsive valve 25, the tab shaped portion 30 commences to convert the fuel gas/air mixture in the combustion chamber 10 to heat by the catalytic reaction, which in turn rapidly raises the temperature of the leg 36, and in turn the gas catalytic combustion element 14 to the ignition temperature, and thereby the fuel gas/air mixture is converted to heat by the gas catalytic combustion element 14.

The gas catalytic combustion element 14 comprises a substrate, which in this embodiment of the invention comprises a metal mesh carrier of an alloy of steel and aluminium, which is coated with a suitable catalytic material, which in this case comprises a precious metal, namely, platinum. The tab shaped portion 30 and the leg 36 from which the tab shaped portion 30 extends are of similar metal mesh material and are coated with a similar catalytic material.

As discussed above, the gas catalytic combustion element 14 is of square transverse cross-section and defines four longitudinally extending peripheral corner edges 38 which engage an inner surface 39 of the body member 3 which forms the combustion chamber 10, and thus, the gas catalytic combustion element 14 only engages the body member 3 along four line contacts defined by the corner edges 38. By virtue of the fact that the gas catalytic combustion element 14 only engages the body member 3 along the four line contacts defined by the corner edges 38, heat transfer by conduction between the body member 3 which is being maintained at a temperature of approximately 140° C. and the gas catalytic combustion element whose ignition temperature is approximately 275° C., is thereby minimised during periods of fuel gas interruption. Additionally, the thermal mass 26 is not in direct heat conducting engagement with the body member 3, and since there is little heat lost by conduction between the gas catalytic combustion element 14 and the body member 3, little heat is lost from the thermal mass 26 to the body member 3 during periods of fuel gas interruption. Thus, the size of the thermal mass 26 consistent with maintaining the temperature of the tab shaped portion 30 at or above the ignition temperature of 275° C. is minimised.

Additionally, by arranging the transverse cross-section of the gas catalytic combustion element 14 and the transverse cross-section of the combustion chamber 10 to be different, in this case, square and circular, respectively, the passage of the fuel gas/air mixture between the gas catalytic combustion element 14 and the inner surface 39 of the body member 3 defining the combustion chamber 10 is facilitated, thereby further enhancing the heat conversion efficiency of the gas catalytic combustion element 14. The size of the thermal mass 26 and the tab shaped portion 30 is such as to accommodate the passage of the fuel gas/air mixture through the bore 15 of the gas catalytic combustion element 14 between the gas catalytic combustion element 14 and the thermal mass 26.

In use, with a glue stick located in the glue accommodating and melting chamber 4 and being urged into the glue accommodating and melting chamber 4, fuel gas from the reservoir (not shown) is supplied through the temperature responsive valve 25 to the venturi mixer 16 where it is mixed with air, and the fuel gas/air mixture is delivered from the venturi mixer 16 through the nozzle (not shown) into the combustion chamber 10. Initially, the fuel gas/air mixture is ignited to burn with a flame for raising the temperature of the gas catalytic combustion element 14 to its ignition temperature. Typically, the fuel gas/air mixture is initially allowed to pass through the exhaust port 19 and ignited to burn with a flame so that the root of the flame sits on a portion of the gas catalytic combustion element 14 adjacent the exhaust port 19. When the root of the flame has raised the temperature of the adjacent portion of the gas catalytic combustion element 14 to its ignition temperature, the portion of the gas catalytic combustion element 14 adjacent the exhaust port 19 commences to convert fuel gas to heat by catalytic reaction, which rapidly raises the temperature of the remainder of the gas catalytic combustion element 14 to its ignition temperature. Once the gas catalytic combustion element 14 has been raised to its ignition temperature, the flame is starved of fuel gas and is extinguished.

Alternatively, an ignition system, typically, a piezo-electric igniter may be provided for igniting the fuel gas/air mixture to burn with a flame in the combustion chamber 10 for in turn raising the temperature of the gas catalytic combustion element 14 to its ignition temperature, and on the gas catalytic combustion element 14 being raised to its ignition temperature, the flame is extinguished. The operation of such piezo-electric igniters will be well known to those skilled in the art, and such an arrangement of a piezo-electric igniter for igniting fuel gas/air mixture to burn in a flame in a combustion chamber for raising the temperature of a gas catalytic combustion element located in the combustion chamber to its ignition temperature is described in PCT Published Patent Application Specification No. WO 97/38265, and the disclosure therein is incorporated herein by reference.

On the gas catalytic combustion element 14 being raised to its ignition temperature, the catalytic combustion element 14 continues to convert the fuel gas/air mixture to heat by catalytic reaction. The temperature of the body member rises, and on reaching 140° C., the temperature is maintained at 140° C., within the temperature bandwidth of approximately +5° C. to −20° C., by the temperature responsive valve 25 by periodically interrupting the fuel gas to the combustion chamber 10. While the gas catalytic combustion element 14 is being supplied with the fuel gas/air mixture, the fuel gas/air mixture is converted to heat by catalytic reaction, and the temperature of the gas catalytic combustion element 14 is raised well above its ignition temperature, thus raising the temperature of the thermal mass 26 well above the ignition temperature. During periods of fuel gas interruption, heat transferred from the thermal mass 26 to the tab shaped portion 30 maintains the temperature of the tab shaped portion 30 at or above the ignition temperature of the gas catalytic combustion element 14. Thus, when the supply of fuel gas is restored by the temperature responsive valve 25, the tab shaped portion 30 immediately commences to convert the fuel gas/air mixture to heat, thus rapidly raising the temperature of the gas catalytic combustion element 14 to its ignition temperature, which again commences to convert the fuel gas/air mixture to heat, and so operation of the glue gun 1 continues.

Referring now in particular to FIG. 5, waveforms illustrating plots of the temperature of a body member 3, a tab shaped portion 30, and a portion of a gas catalytic combustion element 14 remote from the tab shaped portion 30 plotted against time from start-up of a glue gun are illustrated. In this case the glue gun is identical to the glue gun 1 described with reference to FIGS. 1 to 4, with the exception that while the construction and shape of the gas catalytic combustion element is identical to that of the gas catalytic combustion element 14 of the glue gun 1 described with reference to FIGS. 1 to 4, the ignition temperature of the gas catalytic combustion element is higher, and in this case, is approximately 380° C. The gas catalytic combustion element with an ignition temperature of 380° C. was selected in order to show that even operating under the extreme conditions, where the ignition temperature of the gas catalytic combustion element is 240° higher than the temperature at which the body member 3 of the glue gun is to be maintained, the glue gun according to the invention, and the gas catalytic combustion element according to the invention still function in accordance with the invention. The temperature in ° C. is plotted on the Y-axis, and time in seconds is plotted on the X-axis. The waveform A represents the temperature of the body member plotted against time. The waveform B represents the temperature of the portion of the gas catalytic combustion element 14 which is remote from the tab shaped portion 30 plotted against time. The waveform C represents the temperature of the tab shaped portion 30 adjacent the thermal mass 26 plotted against time. A temperature sensor (not shown) from which the temperature, which is represented by the waveform A, and which represents the temperature of the body member 3, was derived was located adjacent the downstream end 7 of the body member 3. Since the downstream end 7 of the body member 3 is further from the combustion chamber 10 than the temperature responsive valve 25, during the initial period from start-up, the temperature of the body member 3 adjacent the downstream end 7 lags the temperature of the body member 3 adjacent the temperature responsive valve 25. Thus, while during the first 200 seconds from start-up the waveforms A, B and C would indicate that the temperature responsive valve 25 interrupted the fuel gas supply to the gas catalytic combustion element 14 prior to the temperature of the body member 3 reaching its operating temperature of 140° C. That was not in fact the case, since the temperature of the temperature responsive valve 25, which is closer to the combustion chamber 10 than the downstream end 7 of the body member 3, would have reached the operating temperature of 140° C. more rapidly than the downstream end 7 of the body member 3. A temperature sensor (not shown) for monitoring the general temperature of the gas catalytic combustion element, and from which the temperature represented by the waveform B was derived was secured to the gas catalytic combustion element 14 towards the downstream end 29 of the catalytic combustion element 14. Thus, the waveform B gives a relatively accurate representation of the general temperature of the gas catalytic combustion element 14. A temperature sensor (not shown) from which the temperature was derived which is represented by the waveform C was clamped between the head 31 of the thermal mass 26 and the tab 30.

Initially, the temperature of the gas catalytic combustion element 14 was raised to its ignition temperature of approximately 380° C. by a suitable ignition means as discussed above. Once the temperature of the gas catalytic combustion element 14 was raised to its ignition temperature, it commenced to catalytically convert the fuel gas/air mixture to heat, and the temperature of the gas catalytic combustion element 14 rose rapidly to a temperature of approximately 650° C., at which it remained, until the first interruption of fuel gas by the temperature responsive valve 25. As can be seen from the waveform C, the thermal mass 26 retards the rise in temperature of the tab shaped portion 30, however, by virtue of the fact that the tab shaped portion 30 is located within the gas catalytic combustion element 14, the temperature of the tab shaped portion rose initially to a temperature exceeding 700° C.

After approximately 125 seconds, the temperature of the body member 3 adjacent the temperature responsive valve 25 reached the upper limit of 145° C. of the operating temperature of the body member 14, and the temperature responsive valve 25 interrupted the supply of fuel gas to the combustion chamber 10. Immediately the temperature of the gas catalytic combustion element 14 commenced to fall relatively rapidly to its ignition temperature, and then more slowly below its ignition temperature. However, the temperature of the tab shaped portion 30 fell off significantly less rapidly than the general temperature of the gas catalytic combustion element 14, due to the heat being conducted from the thermal mass 26 into the tab shaped portion 30. As can be seen from FIG. 5, at time 165 seconds from start-up, when the fuel gas supply was restored by the temperature responsive valve 25, the temperature of the tab shaped portion 30 was approximately 500° C., which was well above its ignition temperature. Thus, on restoration of the fuel gas, the tab shaped portion 30 commenced to convert the fuel gas/air mixture being delivered into the combustion chamber 10 to heat. The heat converting action of the tab shaped portion 30 rapidly raised the temperature of the gas catalytic combustion element 14 to its ignition temperature, which then also commenced to convert the fuel gas/air mixture to heat, and the temperature of the gas catalytic combustion element 14, rose to just over 600° C. At time 175 seconds from start-up, the fuel gas supply was again interrupted by the temperature responsive valve 25, and was restored at time 195 seconds from start-up. However, during the period from time 175 seconds to 195 seconds when the fuel gas supply was interrupted by the temperature responsive valve 25, the temperature of the tab shaped portion 30 did not fall below 430° C., which is well above the ignition temperature of 380° C. of the gas catalytic combustion element 14.

By time 200 seconds from start-up, the glue gun commenced to operate in a steady state condition, with the temperature of the body member 3, including the downstream end 7 thereof, operating at the operating temperature of approximately 140° C. During steady state operating conditions, the general temperature of the gas catalytic combustion element fluctuated between 200° C. and just over 600° C., while the temperature of the tab shaped portion 30 fluctuated between approximately 400° C. and 500° C., and never fell below the ignition temperature of 380° C. of the gas catalytic combustion element 14 and the tab shaped portion 30. Accordingly, during periods of fuel gas interruption the temperature of the tab shaped portion 30 remained above its ignition temperature, and was ready to immediately convert the fuel gas/air mixture to heat on restoration of the fuel gas to bring the remainder of the gas catalytic combustion element 14 to the ignition temperature.

The fact that the temperature of the tab shaped portion 30 lags the general temperature of the gas catalytic combustion element 14 is due to the hysteresis effect imposed by the thermal mass 26 on the tab shaped portion 30.

Referring now to FIGS. 6 and 7, there is illustrated a portion 40 of a glue gun according to another embodiment of the invention. The glue gun 40 is substantially similar to the glue gun 1, and similar components are identified by the same reference numerals. The main difference between the glue gun 40 and the glue gun 1 is in the thermal mass. In this embodiment of the invention the thermal mass is provided by a solid circular plug member 42 of heat conductive material, in this embodiment of the invention copper, which is located within the bore 15 of the gas catalytic combustion element 14. The gas catalytic combustion element 14 in this case is also of square transverse cross-section. The peripheral circumferential surface 43 of the plug member 42 is in heat conductive contact with portions 45 of the gas catalytic combustion element 14 at circumferentially spaced apart intervals around the surface 43 for maintaining the temperature of the portions 45 of the gas catalytic combustion element 14 above the ignition temperature thereof, during periods of fuel gas interruption to the combustion chamber 10. Otherwise, the glue gun 40 is similar to the glue gun 1, and its operation is likewise similar.

In both embodiments of the invention of the glue gun, namely, the glue gun 1 and the glue gun 40, the thermal masses 26 and 42, respectively, are located in the bore of the tubular gas catalytic combustion element 14 so that passage of the fuel gas/air mixture along the inner surface of the gas catalytic combustion element 14 is facilitated. Additionally, the thermal masses 26 and 42 are located in the bore 15 of the gas catalytic combustion elements 14 in order to minimise heat transfer between the body member 3 and the thermal masses 26 and 42, so that the temperature of the body member will have little or no influence on the temperature of the thermal masses 26 and 42.

While specific arrangements of thermal masses in heat conductive contact with gas catalytic combustion elements have been described, it will be readily apparent to those skilled in the art that any other suitable arrangement whereby a thermal mass is in heat conductive contact with the gas catalytic combustion element may be provided. Indeed, it will also be appreciated that the thermal mass may be in other forms of heat transfer relationship with the gas catalytic combustion element besides a heat conductive relationship. For example, the thermal mass may be located to be in a radiant heat transfer relationship with the gas catalytic combustion element.

Additionally, it is envisaged that instead of providing a separate thermal mass, the thermal mass may be integrally formed in the substrate of the gas catalytic combustion element. For example, in certain cases, it is envisaged that a portion of the substrate of the gas catalytic combustion element may be formed to form the thermal mass. For example, a portion of the substrate may be provided to be thicker than the remainder of the substrate, and the thicker portion of the substrate would form the thermal mass.

While the gas catalytic combustion element according to the invention has been described as being located in a combustion chamber, it is envisaged that in certain cases, the gas powered device may be of the type which is not provided with a combustion chamber, in which case the catalytic combustion element would be appropriately located and the thermal mass would be located relative to the gas catalytic combustion element to be in an appropriate heat transfer relationship therewith in order to maintain at least a portion of the gas catalytic combustion element adjacent the thermal mass at or above its ignition temperature during periods of interruption of the fuel gas supply to the gas catalytic combustion element.

While the heating device has been described as being a glue gun, it will be readily apparent to those skilled in the art that the heating device may be any type of gas powered heating device, for example, a soldering iron, a hair curling tongs, a hairdryer, or indeed any other gas powered heating device. It is also envisaged that the heating device may be provided as a heating device for vaporising vaporisable matter from herbs and the like for facilitating inhaling of such vapours by a person. In particular, it is envisaged that the heating device may be provided as a heating device for heating tobacco for vaporising vaporisable matter in the tobacco for inhaling thereof.

While the gas catalytic combustion element has been described as being of square transverse cross-section, the gas catalytic combustion element may be of any suitable transverse cross-section, however, it is desirable that the transverse cross-section of the gas catalytic combustion element should be different to that of the combustion chamber, in order to minimise contact between the gas catalytic combustion element and the body member in which the combustion chamber is formed, particularly where the body member is to be maintained at a temperature at or below, and particularly below, the ignition temperature of the gas catalytic combustion element. Additionally, while the gas catalytic combustion element has been described as comprising a substrate in the form of a mesh material of an alloy of steel and aluminium, the gas catalytic combustion element may be provided with any other suitable form of substrate for carrying a catalysing material, and while the catalysing material has been described as comprising a precious metal, namely, platinum, any other suitable catalysing material may be used. It is envisaged that the substrate, instead of being provided as a metal mesh carrier, may be provided in the form of a fibrous material, or as a ceramic material. Typically, if the gas catalytic combustion element were of a ceramic material, it would be of honeycomb construction, and the thermal mass would be located in an appropriate location relative to the gas catalytic combustion element, and typically, within the gas catalytic combustion element, for example, in one of the bores formed by the honeycomb construction of the ceramic material. It is also envisaged that in general, the thermal mass will be located within the gas catalytic combustion element.

While the thermal mass has been described as being provided by a nut and screw, the thermal mass may also be provided by a rivet, which would be riveted onto the gas catalytic combustion element, and typically, onto a tab thereof.

The invention claimed is:

1. A combination of a gas catalytic combustion element and a thermal mass, the gas catalytic combustion element being for converting fuel gas to heat for heating a body member of a device, the thermal mass being in heat conducting engagement with a portion of the gas catalytic combustion element, so that heat is transferred to the thermal mass from the gas catalytic combustion element when the gas catalytic combustion element is converting fuel gas to heat, and heat is transferred from the thermal mass to the said portion of the gas catalytic combustion element adjacent the thermal mass when the gas catalytic combustion element is not converting fuel gas to heat, the thermal mass being located so that the thermal mass is not in direct heat conducting engagement with the body member with which the combination is to be used, the thermal mass being of size adapted to store sufficient heat for maintaining the said portion of the gas catalytic combustion element adjacent the thermal mass at or above the ignition temperature thereof during periods of fuel gas interruption to the gas catalytic combustion element, so that when the fuel gas supply is restored to the gas catalytic combustion element, the said portion of the gas catalytic combustion element adjacent the thermal mass commences to convert the fuel gas to heat by catalytic action for raising the temperature of the remainder of the gas catalytic combustion element to its ignition temperature.

2. The combination as claimed in claim 1 in which the thermal mass is located within the gas catalytic combustion element.

3. The combination as claimed in claim 1 in which the gas catalytic combustion element is an elongated gas catalytic combustion element having a bore extending therethrough, and the thermal mass is located intermediate the ends thereof.

4. The combination as claimed in claim 3 in which the thermal mass is clamped onto the said portion of the gas catalytic combustion element.

5. The combination as claimed in claim 4 in which the said portion of the gas catalytic combustion element onto which the thermal mass is clamped is formed by a tab shaped portion of the gas catalytic combustion element, and the tab shaped portion of the gas catalytic combustion element extends into the bore formed therein.

6. The combination as claimed in claim 3 in which the thermal mass is located within the bore of the gas catalytic combustion element, and comprises a plug member, the plug member being of transverse cross-section such as to engage the gas catalytic combustion element with the heat conducting engagement at spaced apart locations around the periphery of the plug member, the plug member co-operating with the gas catalytic combustion element for accommodating the passage of fuel gas between the plug member and the gas catalytic combustion element at locations between the spaced apart locations at which the plug member engages the gas catalytic combustion element.

7. The combination as claimed in claim 6 in which the transverse cross-section of the plug member is different to the transverse cross-section of the bore formed in the gas catalytic combustion element within which the thermal mass is located.

8. The combination as claimed in claim 3 in which the thermal mass is located in the bore of the gas catalytic combustion element and is adapted to allow the passage of fuel gas through the bore of the gas catalytic combustion element between the thermal mass and the gas catalytic combustion element.

9. The combination as claimed in claim 3 in which the gas catalytic combustion element is of tubular construction, and the bore extending through the gas catalytic combustion element is an elongated bore extending axially therethrough.

10. The combination as claimed in claim 1 in which the thermal mass is of heat conducting material.

11. The combination as claimed in claim 1 in which the gas catalytic combustion element comprises a substrate and a catalytic material coated onto the substrate.

12. The combination as claimed in claim 11 in which the substrate comprises metal mesh material.

13. The combination as claimed in claim 1 in which the thermal mass comprises a screw having a head and a threaded shank extending therefrom, and a nut is provided on the shank for clamping the said portion of the gas catalytic combustion element between the head and the nut.

14. The combination as claimed in claim 1 in which a bore is formed in the gas catalytic combustion element, and the thermal mass is located within the bore of the gas catalytic combustion element.

15. A gas powered heating device comprising;

a body member having a combustion chamber formed therein, a gas catalytic combustion element for converting fuel gas to heat located in the combustion chamber, and a thermal mass in heat conducting engagement with a portion of the gas catalytic combustion element, so that heat is transferred to the thermal mass from the gas catalytic combustion element when the gas catalytic combustion element is converting fuel gas to heat, and heat is transferred from the thermal mass to the said portion of the gas catalytic combustion element adjacent the thermal mass when the gas catalytic combustion element is not converting fuel gas to heat, the thermal mass being located in the combustion chamber so that the thermal mass is not in direct heat conducting engagement with the body member, the thermal mass being of size adapted to store sufficient heat for maintaining the said portion of the gas catalytic combustion element adjacent the thermal mass at or above the ignition temperature of the gas catalytic combustion element during periods of fuel gas interruption thereto, so that when the fuel gas supply is restored to the gas catalytic combustion element, the said portion of the gas catalytic combustion element with which the thermal mass is in heat conducting engagement commences to convert the fuel gas to heat by catalytic action for raising the temperature of the remainder of the gas catalytic combustion element to its ignition temperature.

16. A gas powered heating device as claimed in claim 15 in which the thermal mass is located within the gas catalytic combustion element.

17. A gas powered heating device as claimed in claim 15 in which the gas catalytic combustion element is located in the combustion chamber for accommodating the passage of fuel gas between the gas catalytic combustion element and the body member.

18. A gas powered heating device as claimed in claim 15 in which the combustion chamber is formed by an elongated bore extending into the body member, the transverse cross-section of the bore forming the combustion chamber being different to the transverse cross-section of the gas catalytic combustion element for minimising contact between the gas catalytic combustion element and the body member.

19. A method for operating a gas catalytic combustion element to heat a body member of a device and to maintain the temperature of a portion of the gas catalytic combustion element at or above the ignition temperature of the gas catalytic combustion element during periodic periods of fuel gas interruption to the gas catalytic combustion element, the method comprising providing a thermal mass in heat conducting engagement with the portion of the gas catalytic combustion element, so that heat is transferred to the thermal mass from the gas catalytic combustion element when the gas catalytic combustion element is converting fuel gas to heat, and heat is transferred from the thermal mass to the said portion of the gas catalytic combustion element adjacent the thermal mass when the gas catalytic combustion element is not converting fuel gas to heat, the thermal mass being located so that the thermal mass is not in direct heat conducting engagement with the body member, the thermal mass being of size adapted to store sufficient heat for maintaining the said portion of the gas catalytic combustion element adjacent the thermal mass at or above its ignition temperature during the periods of fuel gas interruption, so that when the fuel gas supply is restored to the gas catalytic combustion element, the said portion of the gas catalytic combustion element with which the thermal mass is in heat conducting engagement commences to convert the fuel gas to heat for raising the temperature of the remainder of the gas catalytic combustion element to its ignition temperature.

20. A gas catalytic combustion element for converting fuel gas to heat, the gas catalytic combustion element being an elongated gas catalytic combustion element having a bore extending therethrough, and having a thermal mass located within the bore of the gas catalytic combustion element intermediate the ends thereof, the thermal mass comprising a plug member of transverse cross-section such as to engage portions of the gas catalytic combustion element with heat conducting engagement at spaced apart locations around the periphery of the plug member, the plug member co-operating with the gas catalytic combustion element for accommodating the passage of fuel gas between the plug member and the gas catalytic combustion element at locations between the spaced apart locations at which the plug member engages the gas catalytic combustion element, the plug member being of size adapted to store sufficient heat for maintaining the said portions of the gas catalytic combustion element adjacent the thermal mass at or above the ignition temperature thereof during periods of fuel gas interruption to the gas catalytic combustion element, so that when the fuel gas supply is restored to the gas catalytic combustion element, the said portions of the gas catalytic combustion element adjacent the thermal mass commence to convert the fuel gas to heat by catalytic action for raising the temperature of the remainder of the gas catalytic combustion element to its ignition temperature.

21. A gas catalytic combustion element as claimed in claim 20 in which the transverse cross-section of the plug member is different to the transverse cross-section of the bore formed in the gas catalytic combustion element within which the plug member is located.

22. A gas catalytic combustion element for converting fuel gas to heat, the gas catalytic combustion element being an elongated gas catalytic combustion element having a bore extending therethrough, a tab shaped portion of the gas catalytic combustion element extending into the bore formed in the gas catalytic combustion element intermediate the ends thereof, and a thermal mass clamped onto the tab shaped portion of the gas catalytic combustion element in heat conducting engagement with the tab shaped portion of the gas catalytic combustion element, the thermal mass being of size adapted to store sufficient heat for maintaining the tab shaped portion of the gas catalytic combustion element adjacent the thermal mass at or above the ignition temperature thereof during periods of fuel gas interruption to the gas catalytic combustion element, so that when the fuel gas supply is restored to the gas catalytic combustion element, the tab shaped portion of the gas catalytic combustion element adjacent the thermal mass commences to convert the fuel gas to heat by catalytic action for raising the temperature of the remainder of the gas catalytic combustion element to its ignition temperature.

23. A gas catalytic combustion element for converting fuel gas to heat, the gas catalytic combustion element having a thermal mass in heat conducting engagement with a portion of the gas catalytic combustion element, the thermal mass comprising a screw having a head and a threaded shank extending therefrom, a nut provided on the shank of the screw for clamping the said portion of the gas catalytic combustion element between the head and the nut, the thermal mass being of size adapted to store sufficient heat for maintaining the said portion of the gas catalytic combustion element adjacent the thermal mass at or above the ignition temperature thereof during periods of fuel gas interruption to the gas catalytic combustion element, so that when the fuel gas supply is restored to the gas catalytic combustion element, the said portion of the gas catalytic combustion element adjacent the thermal mass commences to convert the fuel gas to heat by catalytic action for raising the temperature of the remainder of the gas catalytic combustion element to its ignition temperature.

24. A gas powered heating device comprising:

a body member, a combustion chamber formed by an elongated bore extending into the body member, a gas catalytic combustion element located in the combustion chamber, the gas catalytic combustion element being of transverse cross-section different to the transverse cross-section of the bore forming the combustion chamber for minimising contact between the gas catalytic combustion element and the body member, and a thermal mass in heat conducting engagement with a portion of the gas catalytic combustion element and being located within the gas catalytic combustion element so that the thermal mass is not in direct heat transfer relationship with the body member, the thermal mass being of size adapted to store sufficient heat for maintaining the said portion of the gas catalytic combustion element adjacent the thermal mass at or above the ignition temperature of the gas catalytic combustion element during periods of the fuel gas interruption thereto, so that when the fuel gas supply is restored to the gas catalytic combustion element, the said portion of the gas catalytic combustion element with which the thermal mass is in heat conducting engagement commences to convert the fuel gas to heat by catalytic action for raising the temperature of the remainder of the gas catalytic combustion element to its ignition temperature.

25. A gas powered heating device comprising:

a body member, a gas catalytic combustion element for converting fuel gas to heat for heating the body member, and a thermal mass in heat conducting engagement with a portion of the gas catalytic combustion element, so that heat is transferred to the thermal mass from the gas catalytic combustion element when the gas catalytic combustion element is converting fuel gas to heat, and heat is transferred from the thermal mass to the said portion of the gas catalytic combustion element adjacent the thermal mass when the gas catalytic combustion element is not converting fuel gas to heat, the thermal mass being located in the combustion chamber so that the thermal mass is not in direct heat conducting engagement with the body member, the thermal mass being of size adapted to store sufficient heat for maintaining the said portion of the gas catalytic combustion element adjacent the thermal mass at or above the ignition temperature of the gas catalytic combustion element during periods of fuel gas interruption thereto, so that when the fuel gas supply is restored to the gas catalytic combustion element, the said portion of the gas catalytic combustion element with which the thermal mass is in heat conducting engagement commences to convert the fuel gas to heat by catalytic action for raising the temperature of the remainder of the gas catalytic combustion element to its ignition temperature.

26. A combination of a gas catalytic combustion element and a thermal mass, the gas catalytic combustion element being for converting fuel gas to heat for heating a body member of a device, the thermal mass being located within the gas catalytic combustion element and being in heat conducting engagement with a portion of the gas catalytic combustion element, so that heat is transferred to the thermal mass from the gas catalytic combustion element when the gas catalytic combustion element is converting fuel gas to heat, and heat is transferred from the thermal mass to the said portion of the gas catalytic combustion element adjacent the thermal mass when the gas catalytic combustion element is not converting fuel gas to heat, the thermal mass being located so that the thermal mass is not in direct heat conducting engagement with the body member with which the combination is to be used, the thermal mass being of size adapted to store sufficient heat for maintaining the said portion of the gas catalytic combustion element adjacent the thermal mass at or above the ignition temperature thereof during periods of fuel gas interruption to the gas catalytic combustion element, so that when the fuel gas supply is restored to the gas catalytic combustion element, the said portion of the gas catalytic combustion element adjacent the thermal mass commences to convert the fuel gas to heat by catalytic action for raising the temperature of the remainder of the gas catalytic combustion element to its ignition temperature.

* * * * *